United States Patent [19]

Gryson et al.

[11] Patent Number: 4,872,488

[45] Date of Patent: Oct. 10, 1989

[54] DEVICE FOR DETERMINING THE POSITION OF A WARP THREAD BREAK

[75] Inventors: Dirk Gryson, Dikkebus-Ieper; Henry Shaw, Vleteren, both of Belgium

[73] Assignee: Picanol N.V., Ieper, Belgium

[21] Appl. No.: 238,124

[22] Filed: Aug. 30, 1988

[30] Foreign Application Priority Data

Sep. 2, 1987 [BE] Belgium ..... 8700983

[51] Int. Cl.[4] ..... D03D 51/30

[52] U.S. Cl. ..... 139/353

[58] Field of Search ..... 116/DIG. 34; 66/163; 139/336, 349, 353, 368, 372; 73/160; 28/187, 205–207

[56] References Cited

U.S. PATENT DOCUMENTS

| | | | |
|---|---|---|---|
| 3,650,128 | 3/1972 | Ferda et al. | 66/163 |
| 4,321,951 | 3/1982 | Hintsch | 139/353 |
| 4,359,068 | 11/1982 | Loepfe et al. | 66/163 X |
| 4,522,236 | 6/1985 | Lohr | 139/353 |
| 4,805,276 | 2/1989 | Plaschy | 28/187 |
| 4,815,498 | 3/1989 | Gryson et al. | 139/351 |

FOREIGN PATENT DOCUMENTS

| | | |
|---|---|---|
| 0234630 | 9/1987 | European Pat. Off. . |
| 276690 | 10/1951 | Switzerland . |

*Primary Examiner*—Andrew M. Falik

*Attorney, Agent, or Firm*—Bacon & Thomas

[57] ABSTRACT

A measuring and detecting device for determining the position of a break in a warp thread on a weaving machine. The machine makes possible a determination as to which side of the device the break is situated, what distance from the device the break is situated, and whether a broken warp thread has come free or has become entangled. The device includes thread guides placed at a distance from each other which can be presented against the warp thread, a mechanism for gripping the broken warp thread and drawing it between the thread guides, measuring devices mounted on the thread guides or on the gripping mechanism, and a processing unit for processing data obtained from the measuring devices.

14 Claims, 2 Drawing Sheets

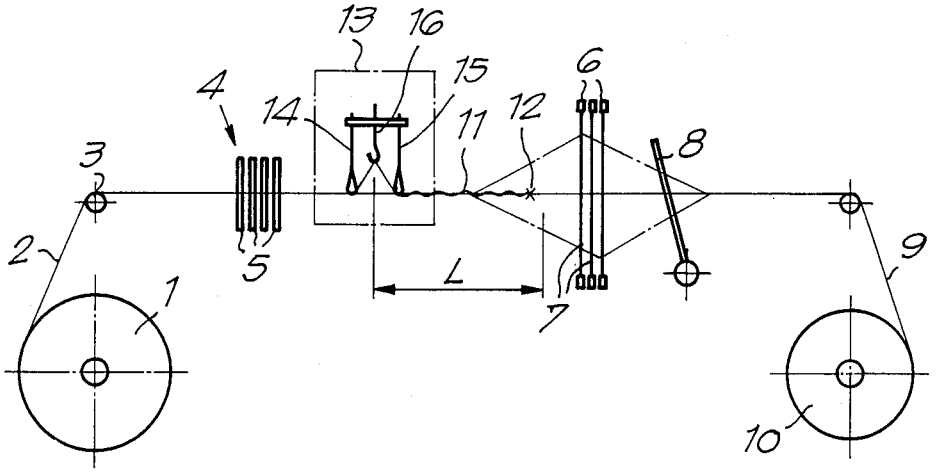
Fig. 1
Fig. 2
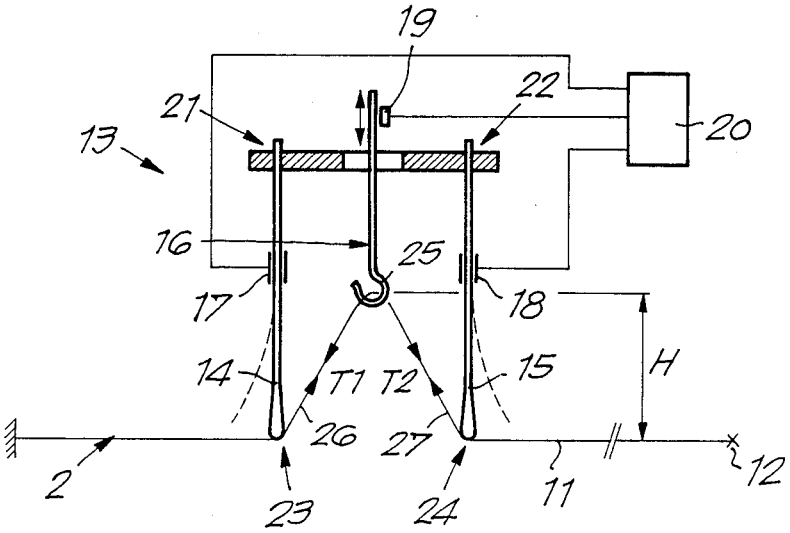

DEVICE FOR DETERMINING THE POSITION OF A WARP THREAD BREAK

BACKGROUND OF THE INVENTION

This invention concerns a measuring and detection device for determining the position of a break in a warp thread on weaving machines. In particular, it concerns a device by means of which it is possible to check whether a broken warp thread has come free or has become entangled, to check on which side of the device the break is situated, and/or at what distance from the device the break is situated.

The measuring and detection device according to the invention can also be used to remove a section of a broken warp thread from the warp.

Devices are known in the art for detecting the location of a broken warp thread. One such device is disclosed in European Patent Application No. 87,201,196, which corresponds to U.S. application Ser. No. 73,003, filed July 10, 1987, and now U.S. Pat. No. 4,815,498. However, the known devices are not capable of determining whether the broken warp thread has come free or has become entangled, or to reliably check specific locations and distances of the break itself once the broken warp thread has been located

SUMMARY OF THE INVENTION

The present invention concerns a measuring and detection device for determining the position of a break in a warp thread on weaving machines, including: two thread guides placed at a distance from each other and which can be presented against the warp on a weaving machine; a mechanism for gripping the broken warp thread and drawing it between the thread guides; detectors and/or measuring devices mounted on the thread guides and/or the above-mentioned mechanism, and which can be influenced by a warp thread which has been gripped; and a processing unit for processing the data obtained from the detectors.

The above-mentioned detectors can, as will be seen from the following description, be of various types, according to the particular purpose for which it is wished to use the measuring and detection device.

BRIEF DESCRIPTION OF THE DRAWINGS

FIG. 1 is a schematic side view of the measuring and detection device in a weaving machine;

FIG. 2 is an enlarged schematic side view of the device of FIG. 1 according to the invention;

DESCRIPTION OF THE PREFERRED EMBODIMENTS

Figure 3:
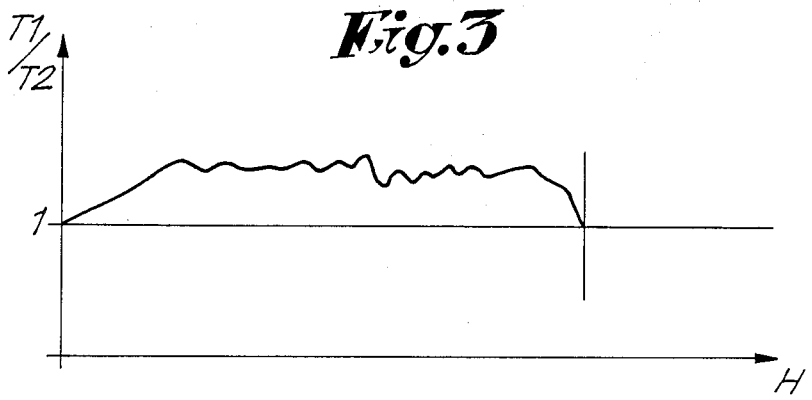
FIG. 3 shows the curve of a value such as can be deduced from the data obtained by means of the device shown in FIG. 2.

FIG. 1 is a schematic illustration of a weaving machine, with the most important components being the warp beam 1, the warp threads 2, the backrest roller 3, the warp stop motion 4 fitted with drop wires 5, the frames 6, the heddles 7, the reed 8, the woven cloth 9 and the cloth beam 10. Also shown in the figure are a broken warp thread 11 and the break 12 in it.

The measuring and detection device 13 according to the invention should preferably be positioned in the zone between the warp stop motion 4 and the frames 6; or it can operate in this zone on the warp 2. The positioning of the device 13 between the warp stop motion 4 and the frames 6 has the particular advantage that a broken warp thread 11 is simple to locate since all warp threads lie parallel to each other. Furthermore, most breaks 12 occur in this area.

As shown in FIG. 2, such a device 13 includes two thread guides 14 and 15 which are mounted at a distance from each other and which can be presented against the warp 2; a mechanism 16 for gripping a broken warp thread 11 and drawing it between the thread guides 14 and 15; a number of detectors and measuring devices, 17 to 19 respectively; and a processing unit 20 for processing the data obtained from the detectors and/or measuring devices 17 to 19.

In the embodiment shown in FIG. 2, the thread guides 14 and 15 consist of elements, such as wires or similar, which can flex elastically in the direction of the warp 2, one end of which, 21 and 22 respectively, is fixed, and the other end of which, 23 and 24 respectively, is free to make contact with the broken warp thread 11.

The mechanism 16 for gripping the broken warp thread 11 and presenting it between the thread guides 14 and 15 consists in FIG. 2 of a hook 25 which can move vertically.

The thread guides 14 and 15 are fitted with detectors 17 and 18 consisting of strain gauges in order to detect the flexure of the elements. The above-mentioned mechanism 16 is in turn fitted with a measuring device 19 in order to measure the displacement H of the hook 25 relative to the warp 2.

Finally, it should be observed that for the purpose of efficient measurement, the hook 25 should preferably be so constructed of a material which subjects the thread 11 to fairly high friction due to contact between the thread and the hook as it passes through this hook.

The operation of the device according to FIG. 2 is as follows: first, the broken warp thread 11 is picked up by the hook 25 after said warp thread 11 has been separated from the other warp threads 2, for example following a method as described in European patent application 87,201,196, which corresponds to U.S. Patent No. 4,815,498 by the present applicant, and drawn upwards in the direction H between the thread guides 14 and 15 such that the free end of the broken warp thread is drawn towards the hook. If the break 12 is situated on the right hand side of the device 13, as shown in FIG. 2, then clearly during the displacement of the hook 25 the broken warp thread 11 will not move past end 23 but past the hook 25 and the end 24 of thread guide 15. As a result of frictional losses in the hook 25, the tensions T1 and T2 in thread ends 26 and 27, between the hook 25 and thread guide 14 and between the hook and thread guide 15 respectively, will be different from each other during the motion of the hook 25, with T1 being greater than T2. This results in different forces being exerted on the ends 23 and 24 of the thread guides 14 and 15, so that they flex by different amounts. By means of strain gauges 17 and 18 a signal is thus measured which is proportional to the tensions T1 and T2. This signal will then used by the processing unit 20.

For example, the ratio of the two values measured is equal to the ratio T1/T2. As shown schematically in FIG. 3, the value of this ratio is greater than "1" as long as the thread is present in the hook 25, and falls back to "1" as soon as the thread leaves the hook. When this occurs, the displacement H can be measured by the measuring device 19, so that the distance L at which the break has occurred is also known because H equals L at this point (i.e., in order to move the free end of the broken thread far enough to pass over the hook, the hook must be raised a distance H=L, where L is the distance from the hook to the break).

Also, the ratio of the tensions T1 and T2 shows on which side of the device 13 the break 12 is situated. Should the break 12 ever be situated to the left of the device 13 that the free end essentially hangs freely from the hook, unlike as shown in FIG. 2, then clearly T1/T2 will be less than "1".

An alternative possibility for calculating L, in particular as regards FIG. 2, is for the hook 25 to be raised until there is no more flexure of thread guide 15, which means that the full length of the broken warp thread 11 is located inside the device, at which moment H approximately equals L/2 for the arrangement shown in FIGS. 1 and 2.

Preferably, the device 13 should be fitted with a mechanism (not shown in the figures) to ensure that the tensile force which can be exerted by the hook 25 is limited to a certain maximum, in order to prevent a second break occurring. In such a case the weaver can intervene to determine the point of the break manually.

Figure 4:
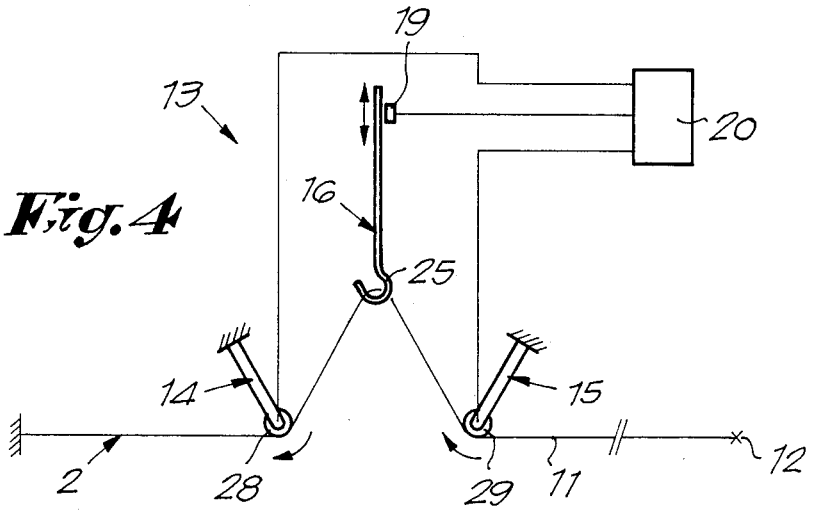
FIGS. 4 and 5 show two variants of the measuring and detection device according to the invention.

FIG. 4 shows another variant of the invention, which uses thread guides 14 and 15 fitted with detectors 28 and 29 which respond to the motion of the warp thread 11 as it passes the guides. Such guides can consist of e.g. motion-sensitive elements fitted with a sensor. In a similar manner to the previous variant, the sensor signals can be used either to determine the side of device 13 on which the break 12 is situated or to determine the above-mentioned length L.

Figure 5:
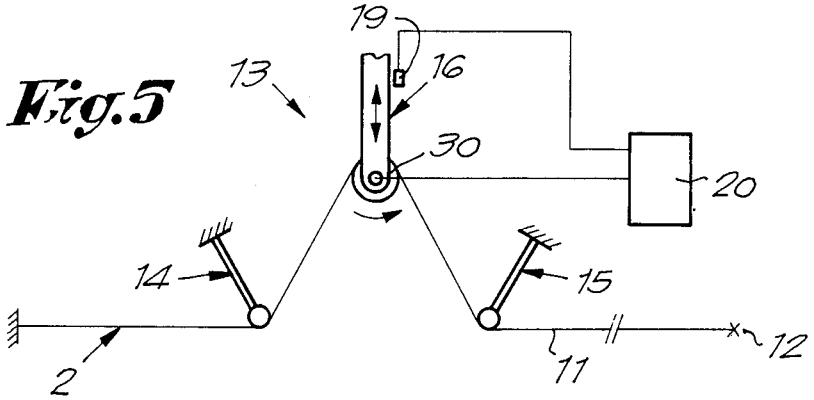

FIG. 5 shows yet another variant in which the mechanism 16 for gripping the broken warp thread is fitted with a detector 30, which in this case also responds to the motion of the broken warp thread 11 past said mechanism 16. This detector 30 may consist of for example a rotating element fitted with a sensor which supplies signals which are a function of the rotation and/or sense of rotation of the rotating element, from which the above-mentioned data may also be deduced.

Clearly, said detectors and/or measuring devices 17 to 19 and 28 to 30 can be combined with each other in various ways within such a device 13.

Clearly also, the mechanism 16 may also consist of a suction nozzle or similar device for raising or pulling on the thread.

The present invention is in no way limited to the embodiments described by way of example and shown in the accompanying drawings; on the contrary, such a measuring and detection device for determining the position of a warp break on weaving machines can be made in various forms and dimensions while still remaining within the scope of the invention.

We claim:

1. A measuring and detecting device for determining the position of a break in a warp thread on a weaving machine, comprising:

flexible thread guides disposed a predetermined distance from each other generally in line with the warp thread;

means including a hook for gripping a broken warp thread and drawing said broken thread between the thread guides, said gripping means and guides being arranged such that said broken thread contacts and flexes at least one of the guides as it is brought between them;

means for measuring flexure of said at least one thread guide when the broken warp thread is drawn between the guides and for generating measurement data based on flexure of the thread guides;

means for processing said measurement data to produce information indicative of the position of said break.

2. A measuring and detecting device as claimed in claim 1. wherein said flexure measuring means includes strain gauges associated with said thread guides.

3. A measuring and detecting device for determining the position of a break in a warp thread on a weaving machine, comprising:

thread guides mounted a predetermined distance from each other generally in line with the warp thread;

means including a hook for gripping a broken warp thread and drawing the broken thread between the thread guides, said hook and guides being arranged such that said broken warp thread contacts the guides as it is brought between them;

means for detecting the presence or absence of said broken warp thread in said device and for generating a signal indicative of said presence or absence of said broken warp thread, the absence of said broken warp thread in said device being indicative of the presence of an end of said broken warp thread in the device;

means for measuring displacement of said hook as it draws said thread between said thread guides and for generating displacement data based on the displacement of said hook;

means for processing said displacement data obtained by said measuring means to determine the position of said break as a function of said displacement data when said detecting means generates a signal indicative of the absence of said broken warp thread from said device.

4. A measuring and detecting device for determining the position of a break in a warp thread on a weaving machine, comprising:

thread guides mounted a predetermined distance from each other generally in line with the warp thread;

means including a hook for gripping a broken warp thread and drawing the broken warp thread between the thread guides, said hook and guides being arranged such that said broken warp thread contacts said guides as it is brought between them;

means for detecting movement of the broken warp thread as the broken warp thread is drawn between the guides, including a rotatable element driven by motion of the broken warp thread as the broken warp thread is drawn between the thread guides;

a sensor arranged to supply a signal which is a function of the degree of rotation of said rotatable element as the broken warp thread moves in relation thereto, said rotatable element ceasing to rotate when an end of said broken warp thread moves past said rotatable element; and means for processing said signal to determine the position of said break according to a predetermined relationship between the degree of rotation of said rotatable element and the displacement of said thread past said rotatable element before rotatable element ceases to rotate.

5. A measuring and detecting device for determining the position of a break in a warp thread on a weaving machine, comprising:

thread guides mounted a predetermined distance from each other generally in line with the warp thread;

means including a hook for gripping a broken warp thread and drawing the broken thread between the thread guides, said guides being arranged such that said broken thread contacts said guides as the broken thread is brought between them;

means for detecting movement of the broken thread as the thread is brought between the guides, including a reversibly rotatable element driven by motion of the broken thread as the thread is drawn between the thread guides and a sensor arranged to supply a signal which is a function of the sense of rotation of said rotatable element; and means for processing said signal to determine the position of said break according to a predetermined relationship between the sense of rotation of said rotatable element and the position of said break.

6. A measuring and detecting device for determining the position of a break in a warp thread on a weaving machine having a warp stop motion and a frame, comprising:

thread guides mounted a predetermined distance from each other generally in line with the warp thread;

means for gripping a broken warp thread and drawing the broken thread between the thread guides, said gripping means and guides being arranged such that said thread contacts said guides as it is brought between them, said guides being responsive to contact with said thread;

means for measuring response of the thread guides to drawing of the broken thread between said guides and for generating break position data based on said response, said data including information related to movement of an end of the broken thread past one of said guides;

means for processing said break position data obtained by said measuring means to determine the position of said break; and means for mounting the device between the warp stop motion and the frame of the weaving machine.

7. A measuring and detecting device for determining the position of a break in a warp thread on a weaving machine having a warp stop motion and a frame, comprising:

thread guides mounted a predetermined distance from each other generally in line with the warp thread;

means for gripping a broken warp thread and drawing the broken thread between the thread guides, said gripping means and guides being arranged such that said thread contacts said guides as it is brought between them, said guides being responsive to contact with said thread;

means for measuring response of the thread guides to bringing of the thread between said guides and for generating break position data based on said response, said data including information related to movement of an end of the broken thread past one of said guides;

means for processing said break position data obtained by said measuring means to determine the position of said break; and means for mounting said device on said weaving machine such that said device can be presented to any thread of the warp.

8. A measuring and detecting device as claimed in claim 7, wherein said thread guides are flexible, and wherein said measuring means includes means for measuring flexure of the thread guides when the broken thread is brought between the guides.

9. A measuring and detecting device as claimed in claim 8, wherein said measuring means includes strain gauges associated with said thread guides.

10. A measuring and detecting device as claimed in claim 7, wherein said measuring means includes motion-sensitive elements on said guides coupled to a sensor which supplies a signal which is a function of motion of said broken thread past said guides, said signal being used by said processing means to determine the position of said break as a function of the degree of movement of said elements before an end of said broken thread has reached said sensor, at which time motion of said element ceases.

11. A measuring and detecting device as claimed in claim 7, wherein said means for gripping includes a hook.

12. A measuring and detecting device as claimed in claim 7, wherein said weaving machine includes a frame and said device is mounted between the warp stop motion and the frame.

13. A measuring and detecting device as claimed in claim 7, wherein said measuring means includes a rotating element located on said gripping means and associated with a sensor which generates said break position data as a function of the rotations experienced by said rotating element in response to movement of said thread.

14. A measuring and detecting device as claimed in claim 7, wherein said measuring means includes a detector on said gripping means which is sensitive to the motion of the warp thread moving past it and which includes a rotating element fitted with a sensor, said sensor generating said break position data as a function of the sense of rotation of said rotating element.

* * * * *